United States Patent [19]

Köhn

[11] 3,957,422

[45] May 18, 1976

[54] METHOD AND DEVICE FOR THE PERIPHERAL HEATING OF MINERAL SUBSTANCES IN SHAFT FURNACES WITH FLUID FUELS AND AIR

[76] Inventor: Georg Bernhard Köhn, 34a Fitgerweg, 2102 Hamburg 93, Germany

[22] Filed: Jan. 23, 1975

[21] Appl. No.: 543,533

[30] Foreign Application Priority Data

Jan. 24, 1974 Germany ..... 2403347

[52] U.S. Cl. ..... 432/3; 432/14; 432/95; 432/96; 432/99

[51] Int. Cl.[2] ..... F27D 1/16; F27B 15/00; F27D 1/08

[58] Field of Search ..... 432/14, 95, 96, 99, 432/266, 3

[56] References Cited

UNITED STATES PATENTS

| | | | |
|---|---|---|---|
| 2,539,638 | 1/1951 | Schilling | 432/96 X |
| 3,248,206 | 4/1966 | Apple et al. | 432/95 |
| 3,721,728 | 3/1973 | Luetzelschwab | 432/266 X |
| 3,722,871 | 3/1973 | Greaves | 432/99 |
| 3,849,061 | 11/1974 | Summer | 432/14 |
| 3,887,326 | 6/1975 | Townley | 432/14 |

*Primary Examiner*—John J. Camby
*Attorney, Agent, or Firm*—Otto John Munz

[57] ABSTRACT

The device and method of the invention embodies a shaft furnace containing no constrictions in the cross section of the shaft furnace that would unfavorably affect the movement characteristics in the filling. The arrangement of the pipes of the burning system in rings composed of closed arcuate pipe segments, adapted to the shape of the shaft furnace cross section and the provision of such pipes with a multiplicity of discharge openings for the fuel and the air of combustion which are uniformly distributed in intimate proximity to each other of horizontal rows of air and fuel pipes over the furnace periphery.

According to the invention it is also feasible to arrange, in dependency on the furnace height and the material to be heat-treated, several pairs of ring pipe lines for fuel and air of combustion, either directly on top of each other in close proximity or in different combustion planes. Controls are provided to make some closed pipes partly or totally inoperative or to operate intermittently, which measure contributes to the good mixing of fuel and air of combustion and thus to the control of the furnace temperature in the individual areas and permits a quick adaptation of the furnace operation to changed conditions. The device can be installed at any time in already existing shaft furnaces without great expense.

In order to avoid an overheating of the pipe lines, the latter are covered with shaped bricks toward the interior of the shaft furnace, with penetration openings which are in alignment with the openings in the pipe lines and agree therewith numerically. The penetration openings may be conically shaped and/or inclined in the direction toward the furnace base, which decreases substantially the clogging hazard of these openings caused by material passing along the shaft lining.

36 Claims, 18 Drawing Figures

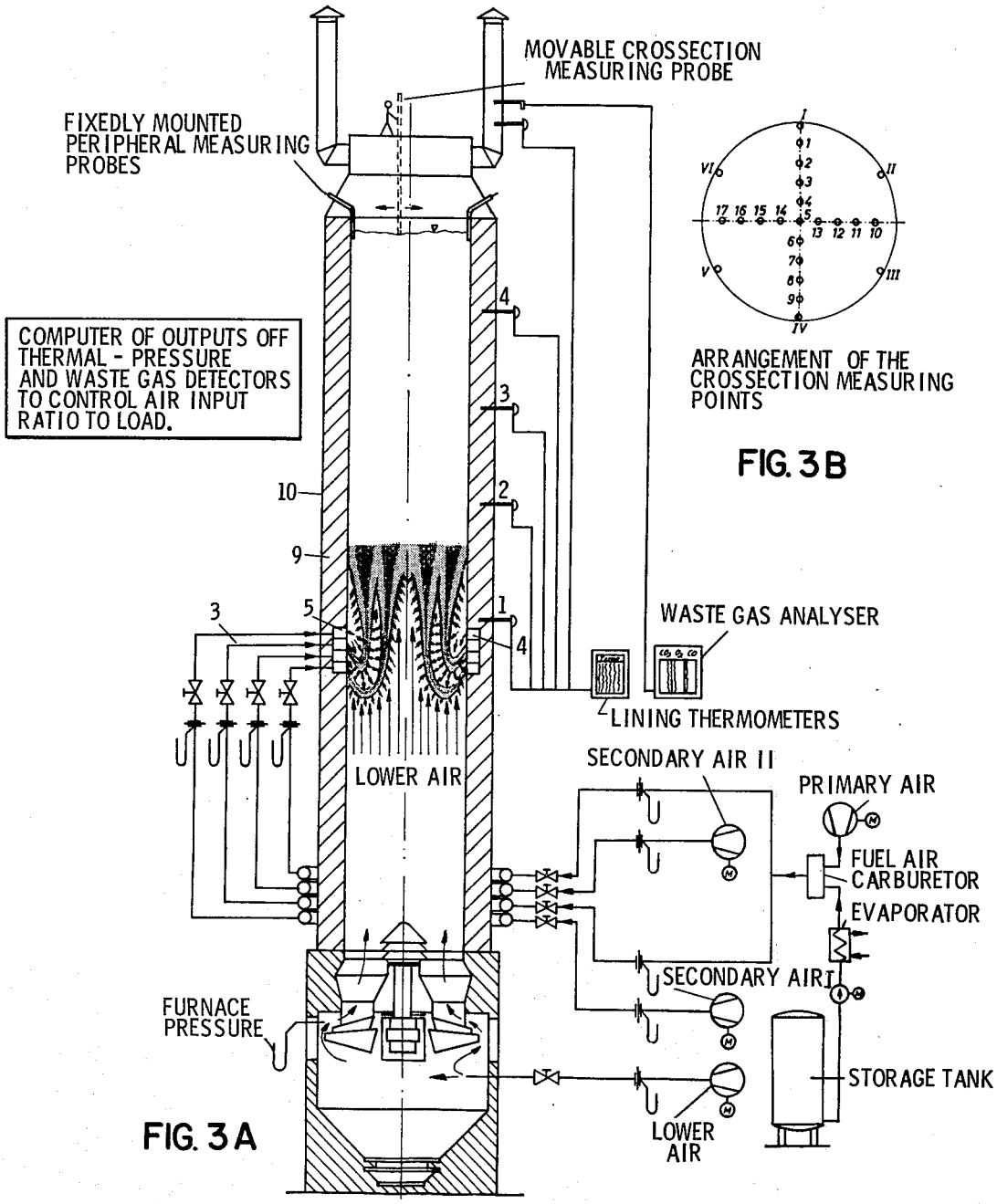
MOVABLE CROSSECTION MEASURING PROBE
FIXEDLY MOUNTED PERIPHERAL MEASURING PROBES
COMPUTER OF OUTPUTS OFF THERMAL - PRESSURE AND WASTE GAS DETECTORS TO CONTROL AIR INPUT RATIO TO LOAD.
ARRANGEMENT OF THE CROSSECTION MEASURING POINTS
FIG. 3B
WASTE GAS ANALYSER
LINING THERMOMETERS
LOWER AIR
SECONDARY AIR II
PRIMARY AIR
FUEL AIR
CARBURETOR
EVAPORATOR
SECONDARY AIR I
FURNACE PRESSURE
STORAGE TANK
LOWER AIR
FIG. 3A

METHOD AND DEVICE FOR THE PERIPHERAL HEATING OF MINERAL SUBSTANCES IN SHAFT FURNACES WITH FLUID FUELS AND AIR

CROSS REFERENCE TO RELATED APPLICATIONS

Priority of corresponding German patent application No. P 24 03 347.4 filed Jan. 24, 1974 is claimed under the Convention.

FIELD OF THE INVENTION

The invention relates to a method and a device for the peripheral heating, with gaseous and/or gasifiable fuels and air, of shaft furnaces for the heat-treatment of mineral substances, in which method and device the entire fuel and a substantial portion of the air of combustion are in each case separately fed in radial flows and in different planes into the shaft furnace in intimately close proximities. (Class 432/97).

DESCRIPTION OF THE PRIOR ART

The prior art failed to realize and to apply several laws of physics and simply operates on the theory that the depth to which a gaseous fuel penetrates into the filling depends on the value of the impulse $p = m \cdot v$ prevailing at the injection point. This premise, however, is correct only as long as an increase in the impulse is brought about by a change in the mass m which produces such an increase.

One of the premises of the present invention is that an increase in the speed — while the mass $m$ remains equal — does not bring about a greater expansion in the filling because the kinetic energy of the impulse is already largely spent or reduced at the closest limestone material, located nearest the origin of the impulse.

Thus when considering the above premise, large masses with small kinetic energy penetrate more deeply than small masses with a great kinetic energy. Therefore, to achieve a greater depth of penetration, the penetrating mass must be increased.

Another premise of the invention is the fact that a flow penetration takes place only when there is a pressure difference and that therefore a second factor that determines the intensity of penetration into the filling is the magnitude of the pressure difference between the feeding point and the surroundings thereof. Factors such as turbulent current and dynamic toughness of the gas are in this instance not separately taken into account since they are of secondary importance and are themselves contributing causes of the aforementioned processes. The pressure level produced in the area of the feeding point is determined by the free volume existing there in the filling, and by the temperatures prevailing there.

As shown on FIG. 1*a* the pressure reduction — and thus the flow from the feeding area — takes place in the direction of the lower resistance, i.e. partially also in a direction opposite to the direction $m_U$ of the main flow in the kiln. Therefore, when a fuel quantity which is large per time unit and which then even strongly increases in volume at high temperature, flows into a free volume in the filling as small as possible, locally high pressures originate. As shown on FIG. 1*b* the masses fed at the periphery of the kiln filling extend in the filling approximately in a kidney-shaped form, i.e., they expand more strongly in the direction of the periphery instead of penetrating radially.

Thus as shown on FIG. 1*c*, fuel fed at several places on a horizontal periphery into the filling, will be distributed in the form of a fuel ring.

As shown on FIG. 1*d*, when injecting orifices for air are arranged in the same manner on a second periphery line directly above the first one, the mass $m_B$ fed in plane I is displaced by the mass $m_L$ fed in plane II, in a direction opposite to the direction of the main flow $m_U$, and likewise toward the middle of the kiln filling.

As shown on FIG. 1*e*, in the filling two ring-shaped areas are produced, with mainly a flow of air passing through one of them, and predominantly fuel passing through the other. The fuel $m_B$ fed peripherally in plane I burns diffusely with the lower air $m_U$ discharged from the base, of the kiln, and with the air $m_L$ fed in plane II. The generation of heat extends thus over a long path in the filling. As a practical result thereof, the fuel does not burn completely, the waste gas temperature rises and the portion of unburned materials in the waste gas increases. Moreover, the air ratio in different smaller or larger areas of the filling cross section varies strongly, resulting in a nonuniform temperature distribution. Shaft furnaces are known, having in each of the various planes up to eight burner openings distributed over the periphery of the shaft. Through each of these burner openings the gaseous or gasified fuel is fed into the shaft furnace with an air inlet opening, assigned, specifically spaced, with respect to the burner opening.

Since the resistance to flow in the shaft furnace is lowest near the furnace lining, fuel and air of combustion expand in the case of such an air and fuel feed, in the direction of the lowest resistance. In this process, the gases which enter the furnace from burners form at the flame fronts hot gas areas which assume approximately the shape of kidneys or cones and penetrate to the furnace center only when special measures are taken. As a result thereof, an excess of a fuel gas develops directly above the fuel feeds and, analogously thereto an air excess exists in other furnace areas, so that a nonuniform heating of the material to be heat-treated throughout the furnace cross section is produced. Thus, unburnt fuel gas as well as excess air are discharged in the waste gases into the open air, which, in addition to a nonuniformly burned material leads to a high fuel consumption. Besides with such a type of a gaseous heating an intensive hard fire can be produced only at great efforts.

Another method for heating shaft furnaces is known wherein from a multiplicity of openings distributed over the periphery of the shaft an ignitable mixture of gas and air is fed into the furnace. Aside from explosion hazard inherent in this process, due to backfires at an insufficient speed of gas discharge from the burner openings, a uniform heating of the material throughout the cross section of the kiln is not possible since the gas flow discharged from the burners burns almost completely in the immediate vicinity of the burner openings.

SUMMARY OF THE INVENTION

The primary object of the invention is to create a method and a device for the peripheral heating of a shaft furnace for the heat treatment of mineral substance by gaseous and/or gasifiable fuels, providing for a uniform distribution of fuel and therefore of heat throughout the cross sectional volume of the shaft furnace at optimum fuel utilization and whereby also an intense hard fire is generated.

Another object of the invention is to provide an equal pressure system in which smaller masses are displaced by larger ones, in such a way that the air of combustion and the fuel are fed into the shaft furnace in a multiplicity of flows which are so close to each other and therefore affect each other in such a way that they form in the filling coherent ring-shaped media flows.

Each feed plane of the fuel and the air of combustion forms a unit and depending on the output required from the shaft furnace, several such units may be provided Thus the characteristics of combustion occurring in the shaft furnace operation in the filling, so far non controllable and resulting in a local weak or excess burning, are counteracted in a planned manner by partial regulation of the flow of fuel and/or of combustion. The feeding according to the invention is carried out in a multiplicity of individual flows of the fuel and the combustion air and thus a large contact surface between the two media is produced, which contributes substantially to a complete combustion of the fuel and has a positive effect upon the production of an intensive hard fire.

In a preferred embodiment of the invention, a plane in each case for the feeding of the combustion air is provided above the feed for the supply of the fuel, so that the ring-shaped media flows exert the mutual effect of displacing each other, in which process the air of combustion promotes the fuel gas distribution throughout the cross section of the shaft furnace since it forces the fuel gas away from the feeding place toward the interior of the furnace.

As an additional improvement an air of combustion flow is assigned to each fuel flow, and each two correlated flows enter, on a common generatrix of the wall of the shaft furnace, the latter.

Optionally waste gas is added to the peripherally fed-in air of combustion, whereby a further possibility of controlling the temperature curve in the shaft furnace is obtained.

The invention permits influencing the temperature curve throughout the shaft furnace by rendering the ratio between the amounts of the radially fed-in air of combustion and of the air of combustion fed-in at the furnace base variable.

The present invention in order to bring about a better mixing and reaction between fuel and air, reduces the lower air $m_U$ to an amount that just barely suffices for the cooling of the lime.

As shown on FIG. 1*f* the decreased portion of the lower air is then fed peripherally to the filling, namely, in such a manner as to be divided into two feeding planes (plane II and IV). The fuel is correspondingly likewise fed separately in planes I and III. This arrangement results in four ring-shaped areas. The air serves consequently to displace the fuel as well as to burn it.

Means are provided to vary the mutual ratios between the peripherally fed air and fuel amounts depending on the conditions and requirements of the lime, i.e. whether it is hard or soft to fire, and on the property of the crude brick employed, and also depending on the size of the shaft diameter of the kiln.

Thus the mixing possibility, the course of combustion, and the penetration are well controlled.

Firing tests were carried out in a firing device with four feeding planes.

BRIEF DESCRIPTION OF THE DRAWINGS

FIG. 3*a* is a vertical cross sectional view partly in diagram of a conventional kiln with the firing device of the invention shown installed in its operational lining;

FIG. 3*b* shows the arrangement of the cross section measuring points;

The drawings are preferably to scale at a diameter ratio of about 2.95 m.

DESCRIPTION OF THE PREFERRED EMBODIMENTS

Figure 1A:
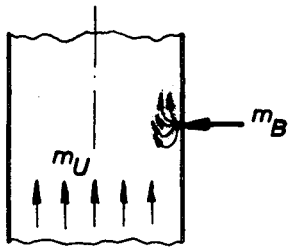
FIGS. 1*a* to 1*e* are diagrammatic sectional views on a common central axis, depicting various critical distributions and directions of pressures in a kiln derived at and utilized by the present invention but considered to be inadequate per se, to produce the optimum results sought.
Figure 1B:
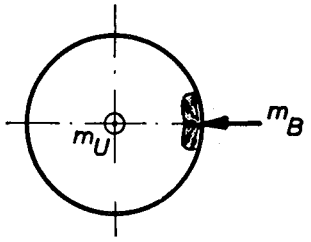
Figure 1C:
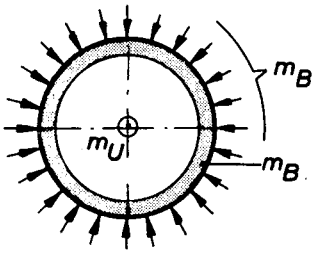
Figure 1D:
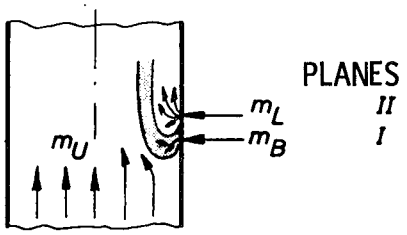
Figure 1E:
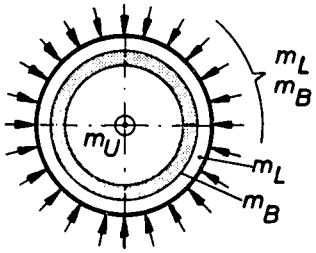
Figure 1F:
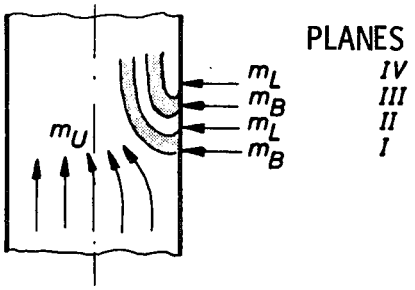
FIG. 1*f* depicts in a section of the kiln diagrammatically an improvement in the mixture and reaction between fuel and air, in accordance with the invention.
Figure 2A:
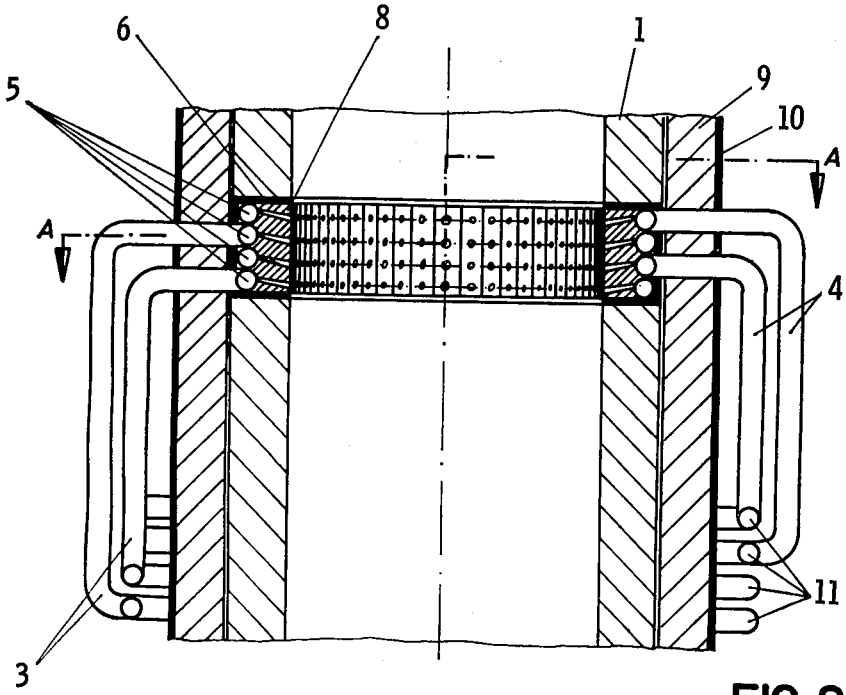
FIGS. 2*a* and 2*b* are: a longitudinal section through a combustion plane of a shaft furnace equipped according to the invention; and a sectional view through the combustion plane of the shaft furnace along line A—A of FIG. 2*a* respectively.
Figure 2B:
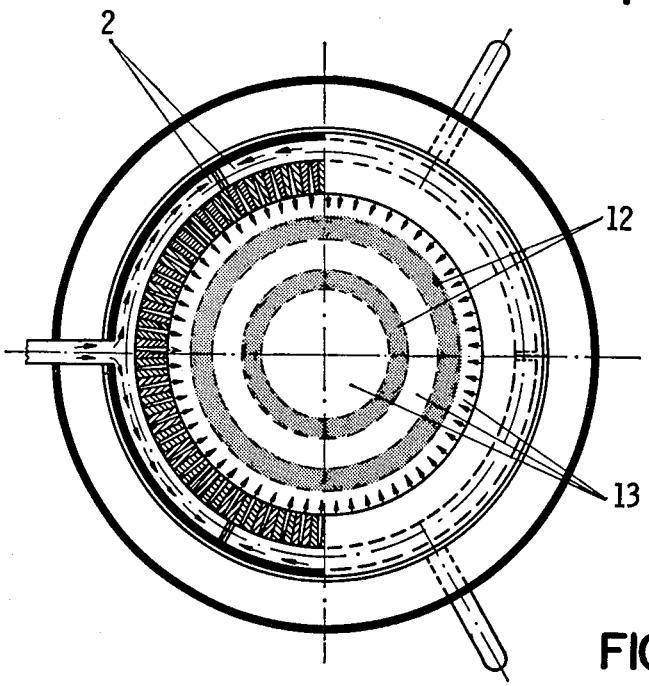

As shown on FIGS. 2 and 3 a combustion system installed in the wall 1 of a shaft furnace, according to the invention comprises several segments 2, each provided with its own feed lines 3 or 4 respectively, for fuel and air required for the combustion. In this structure, as shown on FIG. 3 regulating elements may be installed in all feed lines. The number of the segments depends on the diameter of the shaft furnace and the requirements as to the independent controllability of the fuel and combustion air flows to the individual sections of the filling of the shaft furnace. Each segment comprises a plurality of superimposed sections of closed circuit pipelines 5, which are welded into a U-shaped case structure 6, open toward the longitudinal axis of the furnace. Shaped bricks 7 of fireproof material are also installed in the case structure to protect the closed circuit pipelines from overheating. At least two horizontally adjacent integrally connected closed circuit pipelines define in accordance with the terminology of this specification a segment. Each pipeline is closed at both ends and is in closed circuit connection with its outside fluid supply and inside fluid delivery openings. In such structure, preferably the closed pipeline arranged toward the furnace base, carries fuel. All closed circuit pipelines are provided with openings directed toward the center of the shaft furnace. The openings are preferably arranged side by side closely together and in vertical alignment, in which structure all sections of the closed circuit pipelines combined to a ring are provided with the same number of openings. Each shaped brick 7 is provided with conical penetration openings 8 which numerically agree with the openings in the closed circuit pipelines and extend at a slight inclination in the direction toward the furnace base. The feed lines assigned to each segment penetrate the rear wall 9 and if desired also the steel case 10 of the shaft furnace and form a connection with a closed circuit pipeline system 11 positioned outside the shaft furnace.

The arrangement of the penetration openings, located very closely adjacent to each other and above each other, causes the fuel and air flows discharged from these openings to affect each other with respect to the aforementioned displacement of masses and to form ring-shaped media areas 12 or 13 wherein in each case one of the media predominates and which media displace each other, while being mixed, toward the center of the shaft furnace. This is shown on FIG. 2*b*. Thus, in the case of temperature sensitive limestones, and for the purpose of achieving a good uniform temperature distribution, it is possible to modify the ratio between the amount of cool air entering the shaft furnace base, and the peripherally fed air of combustion, not only with respect to the amount but also to a different degree along the furnace periphery, whereby a local displacement of the ring-shaped media areas and thereby a more balanced temperature characteristic throughout the furnace cross section is produced.

FIG. 3 depicts the firing device of the invention when installed in the operational lining of the shaft kiln so that it can unimpededly move with the expansion of the lining. It comprises three segments which are composed, according to the dimensions of the lining, so as to form a ring. Each segment in turn has four tubular bends, arranged directly on top of each other and welded into a gastight box structure. These tubular bends are provided with a multiplicity of discharge openings. Highly fireproof shaped bricks, likewise provided with discharge openings for fuel gas and air are installed in the box structure and placed in front of the tubular bend. Each individual tubular bend in the tubular bend cluster and in the segment is provided with a fuel gas or air feed of its own, with measuring and control elements. All individual fuel gas and air flows are tapped from four closed-circuit pipelines installed on the outside of the kiln. It is possible to feed variable amounts to each tubular bend in the segment without effect upon other tubular bends.

From the storage tank the liquid fuel, butane was employed, enters an evaporator and therefrom, in a gaseous state, a mixing installation. There a small fraction of primary air is admixed to the fuel gas, so that it no longer condenses on the way to the kiln. The heating value of the mixture of the fuel gas and air remains outside the ignition range. From the mixing installation the mixture of fuel and air is fed to the closed-circuit pipelines on the kiln and therefrom to the individual tubular bends in the segments. When natural gas is used as fuel, the installations mentioned so far, including mixers, are superfluous. The fuel passes then directly from the tapping system, by way of a pressure reducer, into the closed-circuit pipelines on the kiln. Two radial blowers provide, by way of the closed-circuit pipelines, the segments with air of combustion, secondary air I and II. The amounts of fuel gas and air, adjustable by control elements, are measured at the orifices. Of course, the entire plant is secured by locks. In the lining of the kiln, thermoelements for temperature measurement are installed on four measuring planes. The waste gas temperature and the waste gas composition ($CO_2$, $O_2$, CO) of the entire waste gas are being measured. To check the fuel distribution and the intensity of the deacidizing, six measuring probes for tapping gas samples from the filling are rigidly installed on the kiln head, directly at the lining. For determining further gas waste compositions, samples are withdrawn from time to time from various places distributed in a crosswise arrangement over the cross section of the kiln, by means of a movable probe. The heating value of the mixture of fuel, gas and air, and the kiln pressure in the kiln chamber are also being measured.

TEST RESULTS

After the freshly installed tar dolomite lining of the shaft kiln had been laid open by means of a coke fire, the operation of the kiln was converted to gas firing, namely, in such a manner that first half of the amount of heat covered by coke was replaced by gas. After a brief period of operation by mixed firing the entire amount of coke was then replaced by gas and the heat supply was fixed at 950 kcal/kg lime. The division of the amounts of air on planes II and IV, and of fuel gas, on planes I and III was first fixed by computation on the basis of the possible cross sectional distributions of the filling, but was corrected during the testing time on the basis of the measurements of the waste gas cross section. After a short time it was found that, after a modification of the ratio between the amount of lower air and peripheral air, there occurred a rise in the lining temperatures in the temperature measuring planes 1 and 2, as well as a strong increase in $CO_2$ content at all places of cross sectional measurements. The total air ratio was not altered by this measure.

Figure 4A:
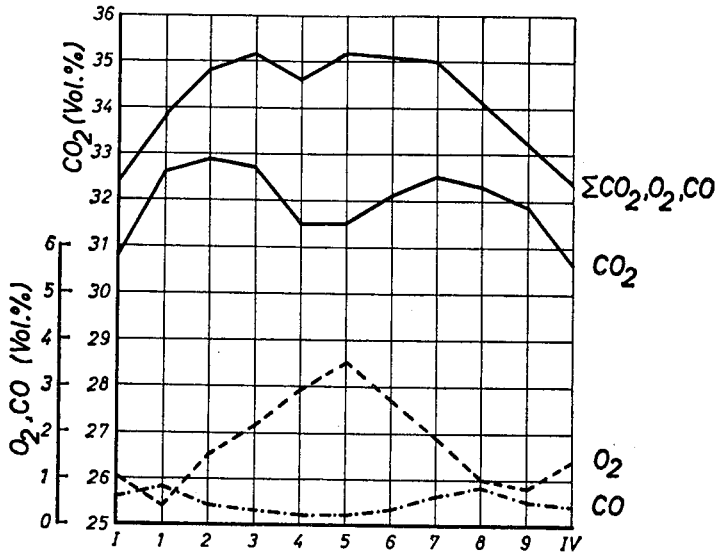
FIGS. 4*a* and 4*b* are graphical representations of test results on the $CO_2$ curve, showing compositions of the gases in the cross section of the kiln.
Figure 4B:
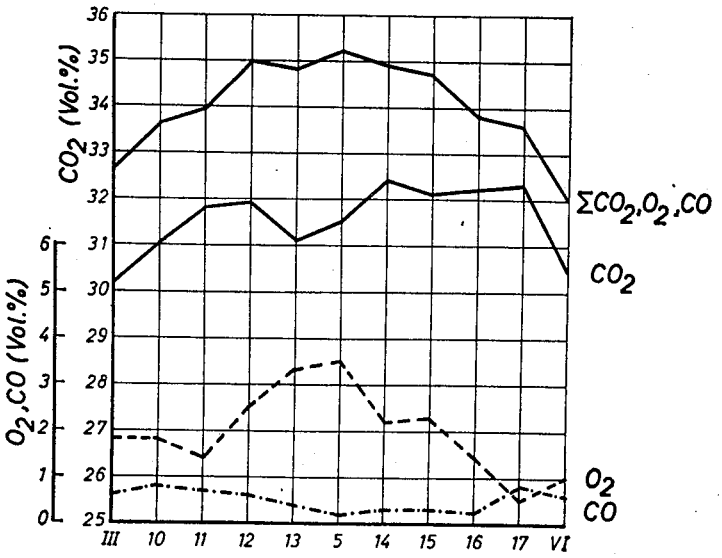
Figure 5:
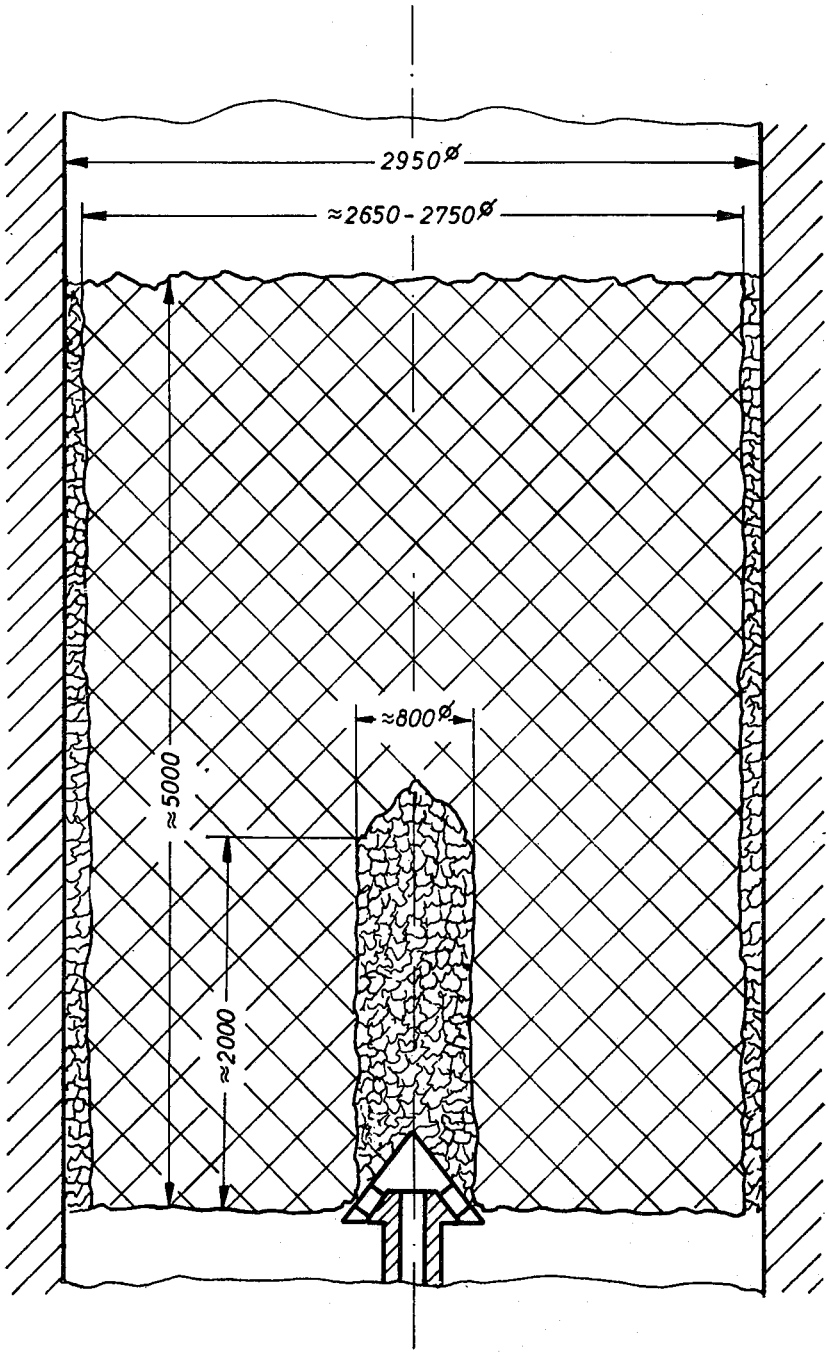
FIG. 5 is a vertical cross sectional view of a portion of the kiln, showing the extent of sintering.

FIGS. 4*a* and 4*b* show graphically the results of a cross section measurement typical at that time, according to the arrangement of measuring places from FIG. 3. The characteristic of the $CO_2$ curve shows clearly that the center of the cross section is sufficiently deacidized. Although the $O_2$ curve shows a still well recognizable preferred "Mittengangigkeit" (middle number of starts) of the lower air measuring place 5, the value of the $O_2$ fraction of $< 4\%$ by volume is surprisingly small. This proves that the relatively large amount of lower air reacts sufficiently with the fuel gas and produces no large cooling area in the middle of the cross section. The quantity of lower air provided for the lime cooling amounted in this case to 0.59 standard cubic meters per kg limestone. The modification of the mutual air ratios, not of the total air ratio, effected a far better mixing with the fuel, and thereby a substantially better final combustion. The CO fractions previously measured at different places on the filling, of up to 5% by volume, were strongly reduced, so that at no place of the cross section more than 0.8% by volume, of CO were present. Due to the recognizably better fuel utilization at the same total air ratio, the waste gas temperature dropped so intensely that in the kiln throat it fell below the dew point of the waste gases ($t_A = 40°$ to 70°C). About 40 hours after these changes, agglomerations were found in the outlet of the kiln which extended over the whole shaft cross section as shown on FIG. 5. To remove the agglomeration, the fuel supply was discontinued and the kiln was emptied completely.

As a result of the strongly improved fuel distribution and utilization, the available heat supply had become too great. It also became obvious that the dolomite lining in the area of the firing device was decomposed by hydration and had already been eroded in places by 100 mm of the lining brick thickness. Between the lining bricks, gaps of a width of up to 5 mm were gaping. The tar dolomite brick had disintegrated, due to the moisture content of the laterally fed air.

Figure 6A:
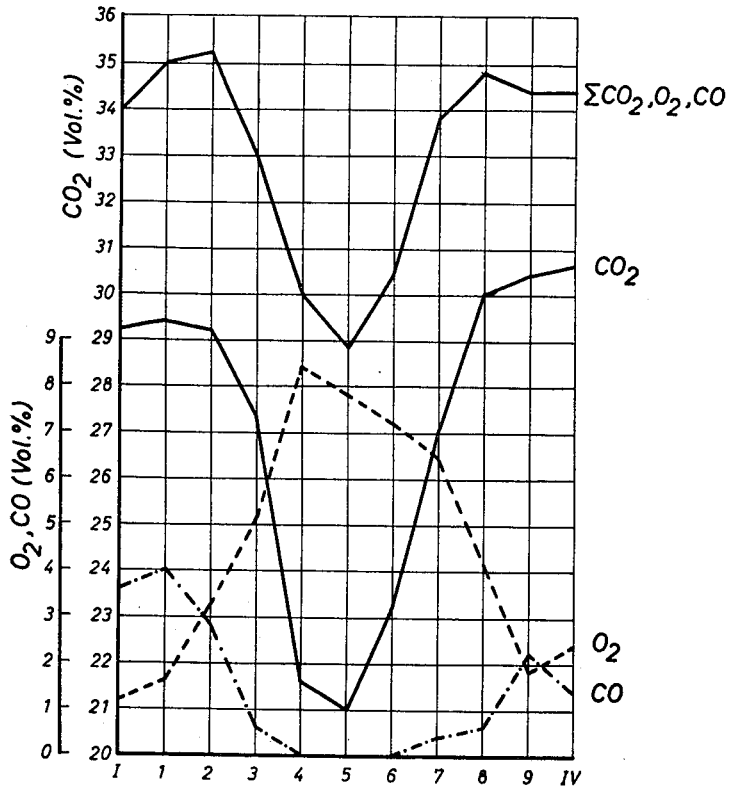
FIGS. 6*a* and 6*b* are graphical representations similar to those of FIGS. 4*a* and 4*b*, showing different inferior results in comparative tests.
Figure 6B:
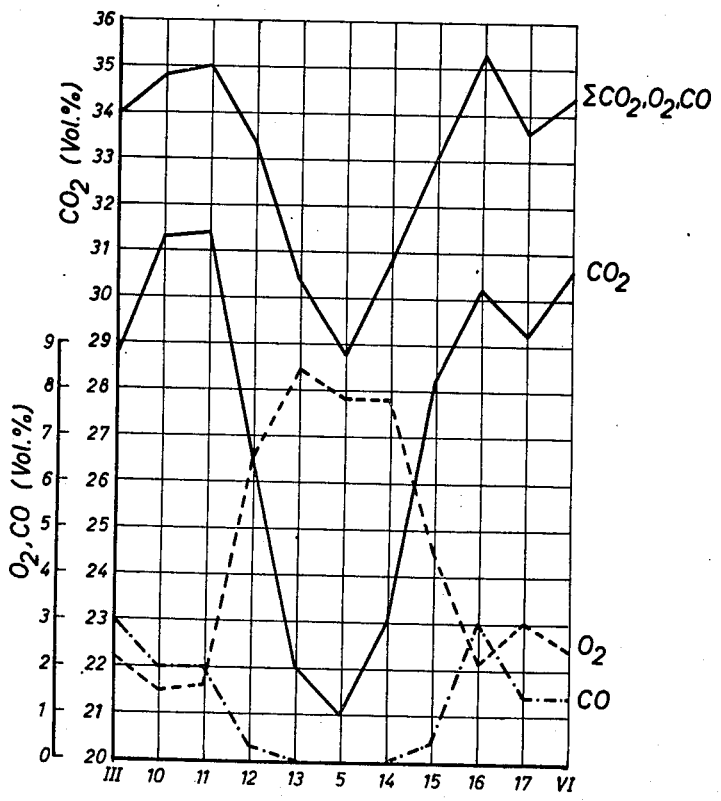

In order to determine whether the depths of penetration of the fuel can be reproduced from the preceding experiment, the gas operation, notwithstanding the damages on the lining, was resumed for a few days, this time, however, only with 780 kcal/kg lime. In the beginning the cross section measurements presented a picture similar to that of the previous test. As time went on, however, while the firing area shifted further downward toward the firing device, so that the temperatures in the temperature-measuring plane 1 rose, the peripherally fed air was no longer capable of displacing the fuel far enough into the filling, since a large fraction of the air flowed in the direction of the smaller resistance, through the dolomite lining now strongly permeable to gas, between the said lining and the rear wall. The hotter it became in the area of the firing device, the higher the pressure rose in the surroundings thereof, and the more air penetrated from the place of feeding into the rear wall. In order to compensate the air losses caused by lining permeability, the peripheral amount of air was increased, in comparison to that of the previous test, to more than twice as much. However, as shown by a cross section measurement at this state on FIG. 6, this was still insufficient. The difference between these results and those shown on FIG. 4 can be distinctly recognized. The amount of peripheral air fed no longer suffices for burning and displacing the entire fuel. As a result, the lower air flows through, to a greater extent, in the middle and produces there a long cooling area wherein the limestone is no longer sufficiently deacidized ($CO_2$ curve).

DISCUSSION OF THE TEST RESULTS

The results have shown that it is possible to heat a shaft kiln filling exclusively in a peripheral manner, namely in such a way that the middle is also still sufficiently deacidized. The following conditions are important:

An aproximately gastight lining in the area of the firing device, so as to prevent a flow in the direction of the rear of the wall;

Promotion of the pressure build-up in the filling at the level of the firing device, by high temperatures;

The peripheral feeding of large amounts of gas and air closely side by side and above each other into a small free filling volume, the "bulk factor", in order to achieve likewise a pressure rise as high as possible;

The reduction was of the lower air to values $\leqq 0.6$ standard cubic meter per kg lime.

The required low heat supply and the fact that the waste gas temperature was low and the fraction of unburnt material, or the excess of oxygen, were very small, prove that fuel utilization is very good. This is understandable also on the basis of the large contact area between the media fuel gas and air of combustion. Due to the air and fuel feeds, symmetrically adapted to the shape of the round shaft, concentrical circular ring areas are formed, in the case of a compactly resting filling, directly above the firing installation level, in which areas, depending on the feeding arrangements, predominantly either fuel gas or air flow along. The two media react with each other while flowing to the kiln head.

Figures 7A, 7B, 7C:
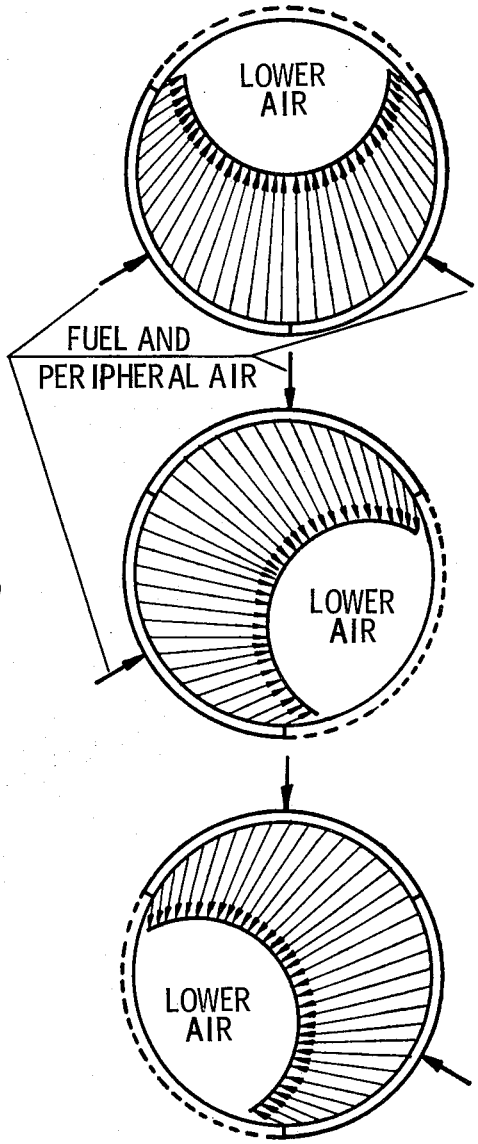
FIGS. 7*a* to 7*c* are perspective views of the distribution of the lower air and fuel with intermittent peripheral fuel supply.

Considering the free filling volume, "bulk factor," above the firing device as the combustion chamber and that the temperatures originating in a combustion chamber during the combustion of a fuel depend on the air ratio, fuel utilization, and size of the combustion chamber, the temperature curve in the filling can be affected by varying one of these factors. If consequently the fuel is being prevented from mixing immediately with the air, combustion is delayed, the heat generation takes place by way of a longer path in the filling, i.e., in a larger combustion chamber. A larger mass of limestone for heat absorption is available to the amount of heat generated in this larger combustion chamber. The maximum temperatures occurring here in the filling material are not as high as in the case of a faster mixing and a smaller combustion chamber resulting therefrom. During the testing period it became clear that, with a better distribution of fuel and air, by the optimization of the proportions in feeding planes I, II, III and IV, the lining temperatures and the waste gas temperature could be controlled. The fact that the peripherally fed fuel will not penetrate to the middle of the kiln cross section to the same extent as it otherwise penetrates, e.g. to half of the radius, is definitely correct as long as the operation is carried out with an amount of lower air required for a sufficient lime cooling, and with a peripheral injected quantity which locally remains continuously the same. If these amounts should, e.g. at a very unfavorable ratio between length and diameter of the shaft kiln, exert aggravating negative influences upon the deacidification of the limestone in the middle of the cross section, the structure of the firing device permits an intermittent and peripheral air feed required through only each two of the available three combustion segments. As shown on FIG. 7, by this measure the lower air which, at continuous operation, flows upward, to a greater extent, in the middle of the cross section is displaced eccentrically with respect to the combustion segment which happens to be inoperative at that instance, whereby the middle is supplied with fuel. At continuous fuel feed, the limestone which descends in the area of the longitudinal axis of the kiln is deacidized by the heat content of the lower air and by the amount of heat supplied from the center half of the cross section, by convection and radiation. Proof of the fact that this generally suffices under normal conditions is furnished by the $CO_2$ cross section measurements according to FIG. 4.

In the operation of all firing segments, the amount of lower air is varied periodically. When, e.g. for the lime cooling an amount of lower air of 0.6 standard cubic meter per kg is required, the quantity fed is subdivided in terms of time, so that alternatingly, e.g. every 2 hours, 0.8 standard cubic meter per kg, and 0.4 standard cubic meter per kg of lime are fed. Inversely, but at the same rhythm of time, the peripherally fed air is varied in the same proportion, so that the total air ratio remains always constant. By this process the ring-shaped fuel areas are displaced, once toward the middle and another time toward the edge. This results in the incidental advantage that the temperature characteristic in the filling shifts steadily, and excessive heating is safely avoided.

What I claim is:

1. A method of constructing in a shaft furnace having an outer pressure tight jacket a heating device, for the peripheral heating with gaseous fuels and air shaft-fillings of mineral substances, comprising the steps of:

providing at least two identical pipes in an integral intimately adjacent parallel alignment;

radially bending said pipes into an arcuate segment for a horizontal assembly of a plurality of such segments into a ring conforming with the inner periphery of said shaft;

closing each said pipe at its end;

providing each of said at least two pipes with a line of outlet orifices in intimate proximity to each other in horizontal planes, aligned vertically and directed toward the inside of said arcuate segments for radial planar expulsions separately of streams of gas and air, respectively, and with exterior inlet orifices for the introduction of gas and air to their respective pipes through said jacket from the outside.

2. A method of constructing a heating device as claimed in claim 1, further comprising the step of:

lining the interior of said shaft with at least one horizontal peripheral row of said segments as a continuous ring;

providing in said jacket gas inlets in conduit assembly with the said exterior inlets of said segments and providing pressurized fuel and air supply means in conduit connections with said inlets.

3. A method of constructing a heating device as claimed in claim 1, further comprising the steps of:

assigning a plane of air flow to each plane of fuel flow, and of directing each correlated two flows to enter the said shaft furnace on a common generatrix of the wall of the shaft furnace.

4. A method of constructing a heating device as claimed in claim 2, said at least two pipes being connected to the fuel- and air supply means, respectively, as a fuel expelling and air expelling pipe, respectively.

5. A method of constructing a heating device as claimed in claim 1, said at least two pipes being provided as four pipes in a horizontal alignment, vertically adjacent to each other;

said shaft being provided with at least one orifice for waste gases, said pipes being connected alternately to the fuel supply and the air supply, respectively, and the waste gas orifice to the air supply.

6. A method of constructing a heating device as claimed in claim 1, further comprising the step of connecting said air supply line also with the bottom of said shaft.

7. A method of constructing a heating device as claimed in claim 1, further comprising the step of controlling variably the delivery of fuel, air and gases to the respective pipes.

8. A method of constructing a heating device as claimed in claim 1, further comprising the steps of:

peripherally supplying the air and fuel to the said segments for symmetrical radial expulsions through said outlet orifices in ring-like planar areas, respectively, in greater quantities and under greater pressures of the air flows, relative to the fuel flows, to cause the radii of the air-ring areas to be larger than those of the fuel-ring areas.

9. A method of constructing a heating device as claimed in claim 1, further comprising the step of covering the interior of said each segment with shaped bricks and providing said bricks with penetration openings in alignment with the inner peripheral openings of said pipes.

10. A method of constructing a heating device as claimed in claim 2, further comprising the step of covering the interior of each said ring with shaped bricks and providing said bricks with penetration openings in alignment with said peripheral openings and agreeing therewith numerically.

11. A method of constructing a heating device as claimed in claim 1, further comprising the step of:

providing said air outlet orifices in a vertical alignment with said fuel outlet orifices and symmetrically forcing the peripheral flow of air to press against and to displace radially the peripheral flow of fuel.

12. A method of constructing a heating device as claimed in claim 9, said lining said of said shaft with at least one horizontal row of said segments comprising the steps of:

lining said shaft with a plurality of horizontal peripheral rows of rings, composed of said segments and spacing at least some of said rings with horizontal rows of bricks in vertically smooth alignment with the bricks and segments of all said rings;

the surface of the lining of said shaft being devoid of protrusions, constrictions and impediments to the movements of the shaft-fillings.

13. A method of constructing a heating device as claimed in claim 1, further comprising the step of: directing the flows of fuel and air, respectively, to cause symmetrical radially widening penetrations thereof within the filling.

14. A method for the peripheral heating, with fluid gaseous and/or gasifiable fuels and air, fillings in shaft furnaces for the heat-treatment of mineral substances, comprising the steps of:

providing a symmetrical multiplicity of separate flows of fluid fuel and air, so closely adjacent to each other that they mutually affect each other and feeding the entire fuel and a substantial portion of the air of combustion separately from each other, in uniform, peripheral, symmetrical radial flows and in different planes, into the shaft furnace to form in the filling coherent flows of ring shaped media.

15. A method for the peripheral heating as claimed in claim 14, furhter comprising the further of feeding the air of combustion in alternating planes with the fuel on the planes positioned above the planes for the supply of fuel in a concerted combined step, so that the ring-shaped media flows exert upon each other an effect of displacement.

16. A method for the peripheral heating as claimed in claim 14, futher comprising the step of assigning an air of combustion flow to each fuel flow, and of directing each correlated two flows to enter the said shaft furnace on a common generatrix of the wall of the shaft furnace.

17. A method for the peripheral heating as claimed in claim 14, further comprising the step of adding waste gas to the air of combustion.

18. A method for the peripheral heating as claimed in claim 14, further comprising the step of:

feeding air of combustion into the filling at the base of the furnace;

the quantitative ratio between the totals of the radially fed-in air of combustion and the air of combustion fed-in at the base of the furnace being variably controllable.

19. A device for peripheral heating in the walls of shaft furnaces of fillings of mineral substances with gaseous or gasifiable fuels comprising:

at least one horizontal ring, composed of closed-end arcuate segments, mating with each other in horizontal assembly, said ring provided in the wall of said furnace, each segment forming at least one closed circuit fuel pipe line for the fuel and one closed circuit air pipe line for the air of combustion, in parallel alignment in planes adjoining each other vertically;

each said pipe line provided with a row of multiplicity of peripheral openings;

said openings radially directed toward the interior of the shaft furnace.

20. A device for peripheral heating as claimed in claim 19, the said closed circuit pipelines being covered with shaped bricks toward the interior of the shaft furnace and provided with penetration openings in alignment with the openings in the said closed circuit pipelines and agreeing therewith numerically.

21. A device for peripheral heating as claimed in claim 20, the penetration openings in the shaped bricks being conical.

22. A device for peripheral heating as claimed in claim 20, the penetration openings being inclined in the direction toward the furnace base.

23. A device for peripheral heating as claimed in claim 19, said ring being subdivided into arcuate segments, said segments mating with each other in a horizontal assembly.

24. A device for peripheral heating as claimed in claim 19, the respective fuel and air openings in the several lines being located intimately horizontally adjacent to each other in close proximities, vertically superimposed and coinciding with each other in numbers.

25. A device for peripheral heating as claimed in claim 24, said air fuel and feed lines of each segment together forming an integrally connected U-shaped structure for building into the wall of said furnace, with outlet openings toward the vertical axis of the furnace.

26. A device for peripheral heating as claimed in claim 24, said fuel and air feed lines of each segment together forming in assembly an integrally connected radial structure for building into the wall of said furnace, with outlet orifices open toward the vertical axis of the furnace, each segment covering an equal portion of the periphery of said wall with all segments forming together ring-shaped peripheral areas.

27. A device for peripheral heating as claimed in claim 19, there being provided at least two said fuel lines and at least two said air feed lines for each segment superimposed over each other in alternating planes, the first fuel line being located in the bottom.

28. An arcuate segment for assembly with other identical mating segments into a horizontal ring as a row of a lining for a vertical shaft-furnace having an outer air-tight jacket, for the peripheral heating of mineral substances with a fluid fuel and air mixture comprising:

at least one pair of identical arcuate pipes, one being a fuel pipe and one being an air pipe, assembled in a parallel, vertically closely adjacent alignment into a horizontal ring;

each said pipe having a row of inner outlet orifices in intimate proximity to each other radially directed toward the inside of the arcuate segment and outer inlet orifices for conduit connections with fuel and air supply respectively.

29. A device for peripheral heating as claimed in claim 28, said segment further comprising:

pressure and thermal detectors of the environments in the walls and the interior of said furnace, waste gas analyzers and means to compute and vary automatically the amount of air supply relative to the quantity of material fed into the furnace to maintain a constant ratio continuously corrected by variations in temperature and pressure and in the waste gas output.

30. An arcuate segment as claimed in claim 28, said at least two pipes being integrally connected with their orifices in vertical alignment.

31. An arcuate segment as claimed in claim 30, further comprising a lining of fire bricks integrally mounted to the interior surface of the said arcuate segment, each said fire bricks being provided with penetration openings in alignment with the openings of said interior outlet orifices.

32. An arcuate segment as claimed in claim 31, said penetration openings being conical and directed axially downwardly at an angle from horizontal.

33. A shaft furnace having an airtight jacket, for the peripheral heating of shaft fillings of mineral substances with fluid fuel and air, comprising:

at least one ring, composed of a plurality of arcuate segments for assembly with other identical mating segments into a horizontal ring as a row of a lining for said furnace;

each said segment having:

at least one pair of identical arcuate pipes, one being a fuel pipe and one being an air pipe, assembled in a parallel vertically closely adjacent alignment into said ring;

each said pipe having a row of inner outlet orifices in intimate proximity to each other radially directed toward the inside of the arcuate segment and outer inlet orifices for conduit connections with fuel and air supply respectively;

said shaft furnace further comprising:

pressurized fluid fuel and air supply means with conduit connections to the said outer inlet orifices of said segments.

34. A shaft furnace having an airtight jacket as claimed in claim 33, said jacket provided with fuel and air inlet orifices;

said at least one ring peripherally mating with the interior of said jacket;

said fuel and air inlet orifices in said jacket being in alignment with the said outer fuel and air orifices of said segments respectively.

35. A shaft furnace having an airtight jacket as claimed in claim 33, said at least one ring being a plurality of rings;

at least two said rings being spaced from each other, and at least one circular horizontal row of bricks interposed within the spacing.

36. A vertical shaft furnace having an airtight jacket, for the peripheral heating of shaft fillings of mineral substances with pressurized supplies of fluid fuel and air, comprising:

at least one horizontal ring as a row of lining in said furnace;

each said ring comprising:

at least one pair of identical circular pipes, one being a fuel pipe and one being an air pipe, alternatively assembled in a parallel, closely adjacent alignment;

each said pipe having a row of inner outlet orifices in intimate horizontal proximity to each other directed downwardly in the same plane toward the inside of the shaft and outer inlet orifices in conduit connections with the said supplies of fuel and air respectively;

the outlet orifices of said pair of pipes being in vertical alignment;

a lining of bricks integrally mounted to the interior surface of the said ring;

each said brick being provided with penetration openings in alignment with the said outlet orifices;

pressurized fluid fuel and air supply means with conduit connections to the said outer inlet orifices of said rings;

said air supply means including additional air inlet conduits to the bottom of said shaft;

means to return waste gases to the said air supply means;

pressure and heat detectors of the environments in the walls and in the interior of said furnace;

waste gas analyzers and means to compute and vary automatically the amount of gas and air supplies relative to the quantity of material fed into the furnace to maintain a constant ratio, continuously corrected by variations in temperature and pressure and in the waste gas output.

* * * * *